United States Patent [19]

George

[11] 4,197,028

[45] Apr. 8, 1980

[54] INTEGRAL CONNECTOR FOR TUBULAR STRUCTURES

[75] Inventor: Henry H. George, Louisville, Ky.

[73] Assignee: Allegheny Ludlum Industries, Inc., Pittsburgh, Pa.

[21] Appl. No.: 965,768

[22] Filed: Dec. 4, 1978

[51] Int. Cl.[2] ..... F16B 1/00

[52] U.S. Cl. ..... 403/208; 403/271

[58] Field of Search ..... 403/206, 207, 208, 384, 403/387, 388, 396, 347, 346, 237, 234, 271, 272; 285/188, 157; 280/281 R

[56] References Cited

U.S. PATENT DOCUMENTS

| | | | |
|---|---|---|---|
| 1,646,974 | 10/1927 | Moyer | 403/206 X |
| 2,338,090 | 1/1944 | Bradfield | 403/346 X |
| 3,226,132 | 12/1965 | Otani | 280/281 R |
| 4,050,829 | 9/1977 | Glanz | 403/382 |
| 4,050,830 | 9/1977 | Paulin | 285/286 X |
| 4,070,126 | 1/1978 | George | 403/271 |
| 4,092,077 | 5/1978 | George | 403/178 |

FOREIGN PATENT DOCUMENTS

| | | | |
|---|---|---|---|
| 2407172 | 9/1974 | Fed. Rep. of Germany | 280/281 R |
| 493994 | 5/1919 | France | 280/281 R |

*Primary Examiner*—Andrew V. Kundrat

*Attorney, Agent, or Firm*—Vincent G. Gioia; John K. Williamson

[57] ABSTRACT

A pre-fabricated welded tubular coupling particularly adapted for use in the construction of offshore platforms comprises a tubular elbow tangentially secured to a straight pipe segment solely along the line of intersection therebetween. A cutout or opening in the backwall of the elbow is configured to complementally receive a portion of the periphery of the pipe to enhance the integrity of the interconnection between the latter and the elbow. The opening has a marginal edge which defines a continuous line of contact with the pipe for welding of the components to form a unitary coupling. In preferred forms, the elbow presents a 90° arc and is arranged such that each leg forms approximately a 45° angle with the pipe. In another embodiment, the elbow extends through 135° and is attached to the pipe in a manner to form approximately 90° and 45° angles between the respective legs and the pipe.

6 Claims, 6 Drawing Figures

INTEGRAL CONNECTOR FOR TUBULAR STRUCTURES

TECHNICAL FIELD

This invention is concerned with tubular structures generally and it particularly relates to an integral joint connector for use in the fabrication of tubular trusses and similar structures.

BACKGROUND ART

With the increase in development of offshore petroleum operations, renewed interest has been exhibited in construction of structures having a high strenghth-to-weight ratio. It has long been known in the art that tubular truss works are one type of structure well suited for such applications. However, one problem with tubular structures has been that of providing a reliable and efficient method of interconnecting the various brace members of a truss in a manner to present a structure having desired strength while exhibiting satisfactory fatigue life. Welding and other conventional joint fabrication techniques have proved to be slow and cumbersome, particularly when constructing a drilling platform in rough seas for example.

One approach to solving the problem alluded to above, is shown in U.S. Pat. No. 4,070,126, issued to H. H. George on Jan. 24, 1978. This patent discloses a number of pre-fabricated connectors used in the construction of tubular trusses. Other connectors of this variety are disclosed in U.S. Pat. Nos. 4,050,829 and 4,092,077. Though these connectors represent an advancement over the prior art, they nevertheless all have a common drawback in that they are relatively expensive to fabricate in comparison with conventional joint fabrication.

DISCLOSURE OF INVENTION

In order to overcome the above-described problems, the present invention provides for a unitary coupling comprising a tubular elbow tangentially mounted on a straight pipe and interconnected to the latter only along the line of intersection formed therewith. In preferred forms, the axes of the elbow and pipe are co-planar and an opening is formed in the outer bend radius section of the elbow for complementally receiving a portion of the arcuate periphery of the pipe intermediate its ends.

The opening in the elbow is particularly sized relative to the diameter of the pipe to provide a pre-determined overlap between the pipe and elbow. A desired degree of overlap is any value yielding a scallop ratio (overlap/cross sectional radius of elbow) in the range of 0.2 to 0.5.

BEST MODE FOR CARRYING OUT THE INVENTION

Figure 1:
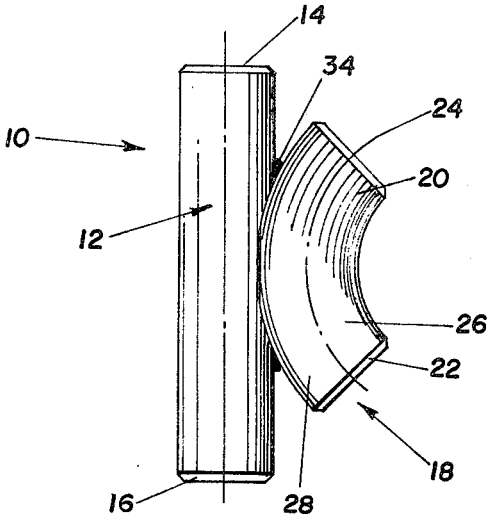
FIG. 1 is a side elevational view of a K-brace type connector constructed in accordance with principles of the present invention.
Figure 2:
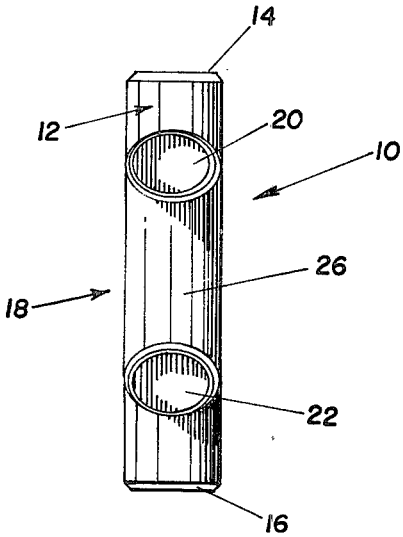
FIG. 2 is a front elevational view thereof.
Figure 5:
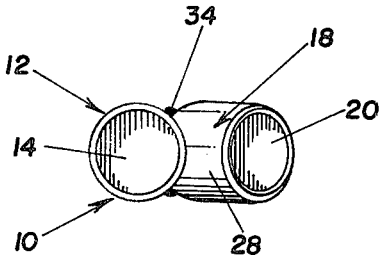
FIG. 5 is a top plan view of the connector.

In FIGS. 1, 2 and 5, there is shown a K-brace connector 10 of a type suitable for forming various tubular joints required in the construction of jack-up drilling rigs and permanent offshore platforms. The connector 10 is constructed of high strength carbon steel, though in certain applications other materials may be suitable depending upon the strength requirements of the structure.

The connector 10 comprises an elongate length of pipe 12 having a pair of opposed open ends 14 and 16, and a tubular elbow member 18 tangentially attached to the pipe 12 in a manner to be described. Like the pipe 12, the member 18 has a pair of opposed open ends 20, 22 which are beveled, as are ends 14, 16, to permit convenient attachment of structural members (not shown) to the connector 10 using conventional single-vee grove joint circumferential butt welds.

The elbow member 18 extends through an arc of approximately 90° and presents a planar, curvilinear axis 24. By virtue of its tubular construction, the member 18 has an annular sidewall which, as viewed in FIG. 1, presents an inner bend radius section 26 on one side of the axis 24 and an opposed outer bend radius section 28 on the opposite side of the axis 24.

Figure 3:
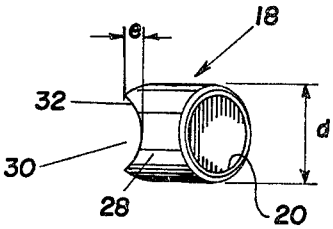
FIG. 3 is a top plan view of the elbow portion of the connector.
Figure 4:
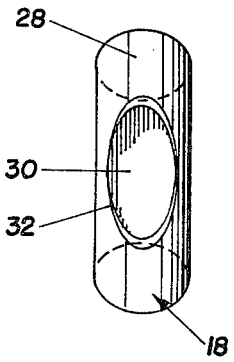
FIG. 4 is a rear elevational view of the elbow.

Considering now FIGS. 3 and 4, there is shown a generally elliptical opening 30 formed in the outer section 28 and having a continuous marginal edge 32. The opening 30 is formed by removing those portions of the member 18 intersected by an imaginary cylinder tangent to the member 18 mid-length thereof and overlapping the latter a distance e as shown in FIG. 3. The sidewall of the member 18 in the areas adjacent the marginal edge 32 is preferably of thicker dimension than the remaining portions of the sidewall; such localized sidewall thickening can be accomplished using conventional elbow-forming techniques.

In preferred forms, the diameter of the imaginary cylinder utilized to form the opening 30 corresponds to the outside diameter of the pipe 12 such that a portion of the outer periphery pipe 12 is complementally received within, and substantially closes, the opening 30 when the member 18 is mated with the pipe 12 as shown for example in FIG. 5. Thus, the marginal edge 32 forms a continuous or unbroken line of contact with the pipe 12 when the elbow and pipe are arranged as shown. A continuous weld bead 34 is laid down along this line of contact for rigidly securing the member 18 to the pipe 12 to form the unitary, high-strength coupling 10.

At this point, it is important to consider the relationship between the dimension e shown in FIG. 3 and the diameter d of the member 18. The ratio of e:d/2, referred to as the scallop ratio, has been found to be critical to the joint efficiency of the coupling 10. Scallop ratios in the range of 0.2 to 0.5 have been determined to be desirable for the construction of the connector 10.

Figure 6:
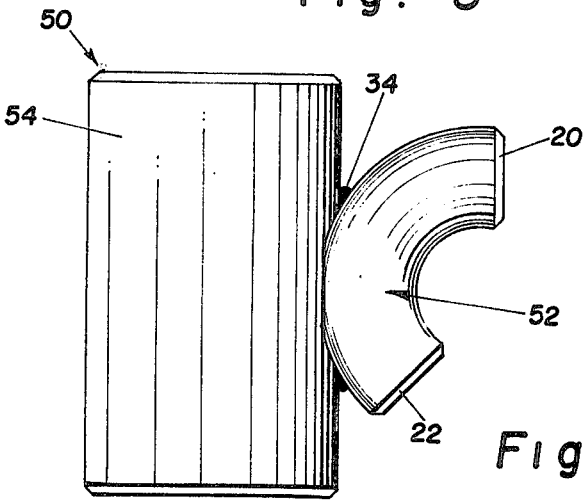
FIG. 6 is a side elevational view of a leg-chord type connector representing a second embodiment of the invention.

Referring now to FIG. 6, a second embodiment is shown comprising a leg chord type connector 50 including an elbow member 52 tangentially attached to an elongate section of pipe 54 in a manner identical to the attachment of member 18 to pipe 12 in connector 10. The pipe 54 is identical in construction to the pipe 12 though it is of somewhat larger diameter because it is adapted to interconnect with the large leg members of a tubular truss structure.

Similarly, the member 52 resembles the member 18, including the provision of a pair of opposed open ends 20, 22 and an annular opening 30 in the outer bend radius section 28 to permit attachment to the pipe 54. However, the member 52 extends through an arc of 135° rather than the 90° of member 18, and further, the opening 30 in member 52 is formed by intersection with an imaginary cylinder at a point located approximately at 45° from the end 22 rather than mid-lenghth of the member 52. In this manner, the member 52 is attached to the pipe 54 such that a tangent extending end 22 intersects the axis 56 of the pipe 54 at approximately a 90° angle and a similar tangent extending from the open end 22 intersects the axis 56 at approximately a 45°. Of course, the diameter of the imaginary cylinder utilized to form the opening 30 in the member 52 corresponds to the larger diameter of the pipe 54. In all other respects, the connector 50 is identical in construction to the connector 10.

INDUSTRIAL APPLICABILITY

As explained, the primary intended use for the connectors 10 and 50 is in the construction of tubular truss works particularly suited for offshore oil operations. The K-brace connector 10 is especially suited for interconnecting cross brace members while the leg chord connector 50 is adapted for securing cross braces to upright legs in the structure.

The connectors of the present invention offer significant advantages over the prior art in terms of increased structural joint integrity and reduced weight. The smooth directional transitions and localized increases in cross sectional area at the point of attachment in the connectors 10, 50 results in high strength-to-weight ratio and improved fatigue life. The connectors disclosed herein permit the construction of high-strength tubular trusses using simplified welding techniques such that construction time, and hence construction costs, can be appreciably reduced. All of the above benefits are realized despite the fact that connectors 10, 50 are relatively inexpensive to fabricate and involve only conventional manufacturing techniques.

What I claim is:

1. A structural connector comprising:

a longitudinally arcuate tubular elbow member presenting an annular sidewall and having a planar, curvilinear axis, said sidewall defining outer and inner bend radius sections on opposite sides of said axis, each being substantially parallel to the axis;

said sidewall having an opening formed therethrough in said outer section said sidewall having locally increased thickness in said outer section adjacent said opening;

an elongate generally cylindrical pipe having a transversely arcuate outer periphery and a rectilinear axis co-planar with said curvilinear axis;

said pipe extending generally tangentially of said member and intercepting the latter adjacent said opening, a portion of said outer periphery of the pipe intermediate its ends being disposed within said opening in substantially closing relation thereto to define an endless line of contact between said sidewall and said periphery; and means intercoupling said members only along said line of contact.

2. The connector of claim 1, said members having the same diameter.

3. The connector of claim 1, said arcuate member extending 90°.

4. The connector of claim 3, said member having an opposed pair of open ends and being disposed relative to said pipe such that tangents to said curvilinear axis at respective said ends each intersect said rectilinear axis at a 45° angle.

5. The connector of claim 1, said arcuate member extending 135° arc.

6. The connector of claim 5, said arcuate member having an opposed pair of open ends and being disposed relative to said pipe such that a tangent to said curvilinear axis at one of said ends is perpendicular to said rectilinear axis, and and such that a tangent to said curvilinear axis at the other of said ends is skewed at an angle of 45° relative to said rectiliner axis.

* * * * *